US006508413B2

(12) United States Patent
Bauer et al.

(10) Patent No.: US 6,508,413 B2
(45) Date of Patent: Jan. 21, 2003

(54) REMOTE SPRAY COATING OF NUCLEAR CROSS-UNDER PIPING

(75) Inventors: James Alan Bauer, Gibsonia, PA (US); George Franklin Dailey, Pittsburgh, PA (US); Mark William Fischer, Pittsburgh, PA (US); Dwight Owen Willaman, Irwin, PA (US); Michael J. Metala, Murrysville, PA (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 103 days.

(21) Appl. No.: 09/821,974

(22) Filed: Mar. 30, 2001

(65) Prior Publication Data

US 2002/0003173 A1 Jan. 10, 2002

Related U.S. Application Data

(60) Provisional application No. 60/195,504, filed on Apr. 6, 2000.

(51) Int. Cl.[7] ..... B05B 3/00

(52) U.S. Cl. ..... 239/227; 239/245; 239/264; 118/317; 118/306; 118/DIG. 10

(58) Field of Search ..... 239/225.1, 227, 239/722, 264, 245, 104; 118/317, 306, 323, DIG. 10, 679–681

(56) References Cited

U.S. PATENT DOCUMENTS 3,071,107 A * 1/1963 Stanley ..... 118/306
3,839,618 A 10/1974 Muehlberger
4,036,173 A * 7/1977 Nicklas ..... 118/DIG. 10
4,649,858 A 3/1987 Sakai et al.
5,452,854 A 9/1995 Keller
5,829,461 A * 11/1998 Ramsey ..... 134/167
5,837,959 A 11/1998 Muehlberger et al.
5,913,977 A * 6/1999 Nichols ..... 118/306
6,051,803 A 4/2000 Hale, Jr.
6,171,398 B1 1/2001 Hannu

FOREIGN PATENT DOCUMENTS

JP 404123972 A * 4/1992 ..... 118/317

OTHER PUBLICATIONS

R.W. Smith; "Equipment and Theory, A Lesson From Thermal Spray Technology," Thermal Spray Technology (1993); pp 1–3; Materials Engineering Institute.

* cited by examiner

*Primary Examiner*—Michael Mar
*Assistant Examiner*—Dinh Q. Nguyen

(57) ABSTRACT

A machine (10) that can clean and spray coat the inside of a hollow pipe (14) can contain a support bar (16) and associated motors (6 and 8) with a moveable carriage (12) which mounts a thermal spray coating device (28) and/or an abrasion cleaning/profiling head (30) where a programmable controller external to the pipe is capable of controlling the motors (6 and 8).

12 Claims, 3 Drawing Sheets

REMOTE SPRAY COATING OF NUCLEAR CROSS-UNDER PIPING

CROSS REFERENCE TO RELATED PATENT APPLICATION

This application claims the benefit of U.S. Provisional Patent Application No. 60/195,504 filed on Apr. 6, 2000 under 35 USC 119.

BACKGROUND OF THE INVENTION

1. Field of the Invention

The present invention relates to a remote mechanical positioner for use with a thermal spray coating process. Radial and axial velocities and acceleration, parameters which are critical to uniform application of the coating, are controlled using programmed stepper motors. Recent applications of the thermal spray coating process include nuclear turbine cross-under piping. The positioning machine is modular and can be easily installed through a 12×18-inch manway opening typically found in the cross-under piping.

2. Background Information

Thermal spray coating has been a well-known useful technology for many years, as described in *Thermal Spray Technology,* "Equipment and Theory"; R. W. Smith, Materials Engineering Institute, pp. 1–3 (1993), and includes combustion coating; plasma coating and electric/wire-arc coating. The primary application has been the coating of large digester tanks found in papermills. Recently, it has been thought useful for the inside of nuclear turbine cross-under piping for corrosion-erosion protection. Coating the inside of these pipes is, however, a very labor-intensive job. The surface to be coated must be first cleaned by conventional abrasive blasting to remove scale and surface contaminants. After this, a profile abrasive is pressure-blasted onto the surface to produce a whitemetal clean surface with a 0.0025 cm to 0.0127 cm (3 to 5 mil) anchor tooth profile surface finish. Once this is done, the surface must be thermal spray coated within four hours or an oxide (rust) will form on the surface inhibiting the bond quality of the thermal spray coating, which is typically a corrosion-erosion resistant material.

Thermal spraying, which includes plasma spraying and other coating processes such as combustion flame and electric/wire arc, is a well-known coating technique described, for example, in U.S. Pat. Nos.: 3,839,618; 4,649,858; 5,452,854; and 5,837,959 (Muehlberger; Sakai et al.; Keller; and Muehlberger, et al., respectively).

The person doing the thermal spray coating has to work on his knees inside a 91½ cm (3-inch) diameter pipe wearing a blasting hood with a separate breathing supply. It is a physically demanding job that requires frequent rest periods, especially when the worker is abrasive blasting or thermal spraying overhead. Visibility is also a problem during either the abrasive blast-cleaning, profiling, or thermal spraying operations. The process generates a fair amount of smoke, and the actual thermal spray process literally produces a fountain of molten and particles, which are propelled against the surface to be coating using pressurized air or an inert gas. Approximately 20% of these molten particles wind up on the bottom of the pipe and must be cleaned up with a suitable vacuum cleaner.

Another problem with the manual application of a thermal spray coating concerns coating thickness. The goal is to apply a coating of uniform thickness over the whole area to be coated. When this is done manually, it is more difficult to achieve a uniform coating thickness. Measurements of the final coating thickness do show significant thickness variations when applied manually. An apparatus for cutting interior conduit surfaces and another for coating them are taught in U.S. Pat. Nos. 6,051,803 and 6,171,398 B1 (Hale and Hammer, respectively). Both teach rather complicated apparatus.

For the reasons above, there is a need to design and build a simplified remote application tool, which would allow remote application of the blasting, profiling, and thermal spraying operation. The main feature needed for the design is the ability to easily pass all parts of the machine through the 12×18-inch (30.5×45.7 cm) elliptical manway, and then assemble them in the cross-under pipe.

SUMMARY OF THE INVENTION

Therefore, it is a main object of this invention to provide an apparatus to coat the interior surface of hollow elongated conduits or pipes, which will allow application of thermal sprayed coatings, especially electric/wire arc coating, in cross-under pipes and the like.

These and other objects of the invention are accomplished by providing a machine for coating the interior surface of a hollow, axially elongated pipe characterized by comprising: a center portion of a support bar which can be aligned concentric with the centerline of the pipe; at least two tripods having at least three legs to contact the interior of the pipe and support the center portion of the support bar; at least one moveable carriage which can travel axially within the pipe, rotatably attached to the center portion of the support bar, said carriage containing at least one thermal spray coating device which extends from the carriage towards the interior of the pipe; a source of thermal sprayable material; a motor to drive the carriage axially; a motor to rotate the center portion of support bar and the carriage; a programmable controller external to the pipe which is capable of controlling the motors and thermal spray coating device. Preferably, all interior components of the coating apparatus are themselves protected, typically with an abrasion resistant plastic material. Also, the extension thermal spray device is adjustable in increments.

This provides a programmable thermal spraying apparatus for use in the interior of conduits such as axially elongated pipes that can be aligned concentric with the centerline of the pipe and which is adjustable and can coat the inside of the pipe. The same machine can also contain an abrasion cleaning/profiling head to first clean the pipe before coating it.

BRIEF DESCRIPTION OF THE DRAWINGS

The above and other advantages of the invention will be more apparent from the following description in view of the drawings in which.

DETAILED DESCRIPTION OF THE PREFERRED EMBODIMENTS

Figure 1:
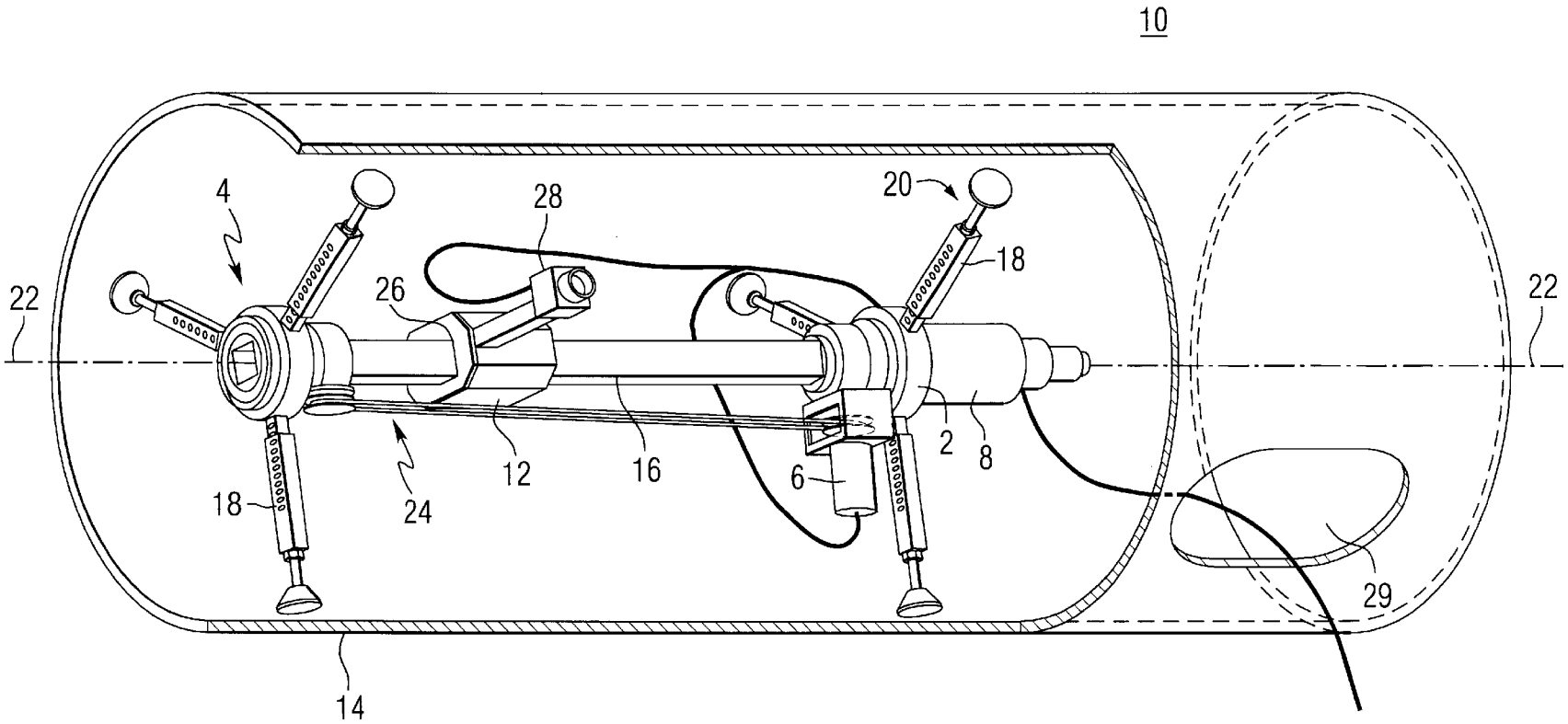
FIG. 1 shows all the main features of the coating machine of this invention showing an attached thermal coating device, here a spray gun.

The main features of the machine 10 include the following design features as shown in FIG. 1. All components are double sealed against the ingress of blasting grit and profiling hardened particles. Sealing is accomplished by double lip seals backed up with felt seals on all rotating surfaces where grit penetration could jam or wear the components. The outer surfaces of the two tripod assemblies and 2 and 4, axial motor 6, rotation motor 8, and moveable axial carriage 12 are coated with polyurethane. Tests have shown that the sand and hardened grit simply bounce off the polyurethane thereby completely protecting the aluminum directly underneath the polyurethane. The machine is supported on two adjustable tripod assemblies which are directly adjustable to work in a pipe 14 from 32 to about 48 inches (81 to about 123 cm), and beyond, inside diameter. By changing out the inner part of each telescoping leg, larger or smaller sized pipes can be easily accommodated. A rubber bellows (not shown in FIG. 1) can be used to fit over each tripod leg and prevent the entry of grit into the telescoping legs.

The center support bar 16 can be a 2.5-inch (6.35 cm) square 0.105-inch (0.26 cm) wall steel tube which can be assembled in any convenient incremental lengths from up to 10 foot (254 cm) long sections typically 5 to 10 foot (152 to 254 cm) sections, which rigidly snap together to form a smooth centered shaft. The six tripod legs 18 have adjustable levelers 20 so that the square tube can be aligned concentric with the centerline 22—22 of the pipe 14. The square tube slides into the left tripod support and is held in axial position by a shaft clamp. The center of the tripod rotates on Kaydon slim-line bearings which permit full 360-degree rotation of the center shaft. The Kaydon bearings are pre-loaded against each other to eliminate play and backlash. The right tripod support 2 is similar to the left in construction except that it also supports the rotation and axial position motors 8 and 6 respectively. Both of these motors are Compumotor Microstepping motors. Each has 10,000 steps per revolution, which means that all motion factors such as speed, acceleration, peak velocity, and reverse times can be totally and accurately controlled via a programmable controller. This is very important from the standpoint of consistent, repeatable thermal spray coating application. Each motor couples directly to a gearbox to increase torque and generate the optimum spray rate. The axial position gearbox ratio is 50:1 which translates into up to 9 inches (22.8 cm) per second of axial travel.

The rotation axis uses a harmonic drive gearbox with zero backlash (160:1) ratio resulting in tangential speeds of up to 3 ft. (91 cm) per second. The harmonic gear reducer contains a flexspline (an elliptical, nonrigid external gear), a circular spline (a round, rigid internal gear), and a wave generator (an elliptical ball bearing assembly). The elliptical wave generator input deflects the flexspline to engage teeth at the major axis. The flexspline teeth at minor axis are fully disengaged—where most of the relative motion between teeth occurs. The flexspline output rotates in opposite direction to input. The rigid circular spline is rotationally fixed.

The teeth on the nonrigid flexspline and the rigid circular spline are in continuous engagement. Since the flexspline has two teeth fewer than the circular spline, one revolution of the input causes relative motion between the flexspline and the circular spline equal to two teeth. With the circular spline rotationally fixed, the flexspline rotates in the opposite direction to the input at a reduction ratio equal to one-half the number of teeth on the flexspline. This relative rotation may be seen by examining the motion of a single flexspline tooth over one-half an input revolution. The tooth is fully engaged when the major axis of the wave generator input is at 0°. When the wave generator's major axis rotates to 90°, the tooth is fully disengaged. Full reengagement occurs in the adjacent circular spline tooth space when the major axis is rotated to 180°. The motion repeats as the major axis rotates another 180° back to 0°, thereby producing the two tooth advancement per input. All tabulated harmonic drive gear reduction ratios assume a split through the flexspline with the circular spline rotationally fixed. However, any drive element may function as the input, output, or fixed member.

All harmonic drive cup-type gearing products have zero backlash at the gear mesh. Under most circumstances, this zero backlash lasts beyond the expected life of the drive. This unusual characteristic is due to the unconventional tooth path combined with a slight cone angling of the teeth caused by deflection of the cup walls. Together, these factors produce preload and ensure very little sliding and no relative motion between teeth at the points where most of the torque is transferred.

While a small amount of backlash occurs at the oldham input coupling, because of the high ratios involved, this backlash becomes negligible when measured at the output. Even this backlash can be eliminated by coupling directly to the wave generator. These are the same type of gear reducers as are used on robots which find extensive use in steam generators for nuclear power plants.

The axial carriage 12 rides on the chrome plated steel center tube 16. The aluminum housing of the carriage, which is polyurethane coated to prevent erosion houses eight polyurethane rollers which roll on the square tube. This housing is pulled along the square tube by a friction-type cable, sprocket chain assembly or other similar type drive 24 which was selected due to its ability to continue to operate with all the abrasive particles present. There are no gears or ball screws to jam with grit. It should also be mentioned that the axial carriage has felt wipers, shown generally at 26, to knock the grit off the square tube so the polyurethane wheels ride on a grit-free surface. FIG. 1 shows the thermal spray gun 28 attached to the arm on the axial carriage. The manway is shown as 29.

Figure 2:
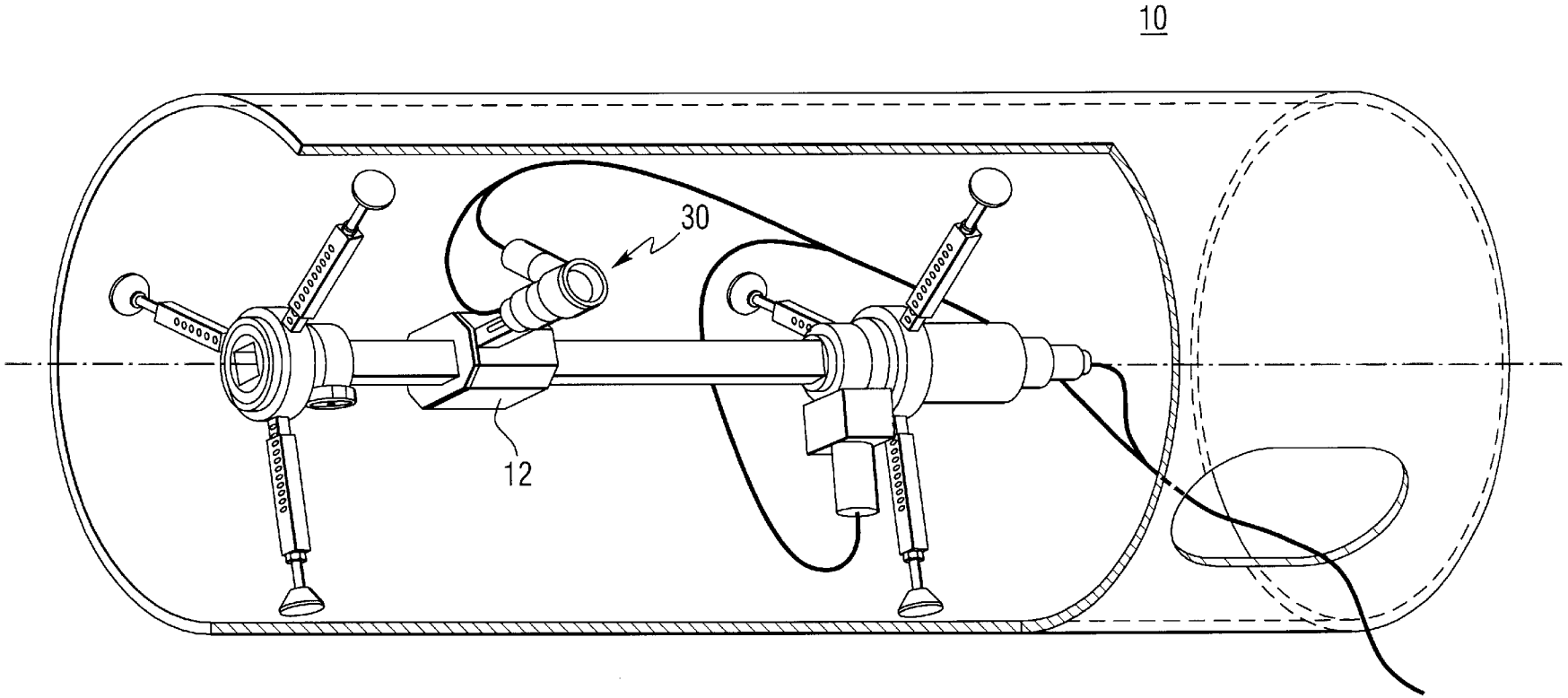
FIG. 2 shows the machine of FIG. 1 with an attached profiling, abrasive air-blasting head.

FIG. 2 shows that if the same arm and drive system operates slowly enough, approximately one inch (2.54 cm) per second peak absolute speed, an abrasion cleaning profiling operation with abrasive grit, using the profiling head 30 can be accomplished. There is an advantage of the programmable stepper motors; they can be programmed to move at any desired speed, less than 2.5 cm of arm tip movement per second all the way up to top speeds of 3 feet (91.4 cm) per second.

Figure 3:
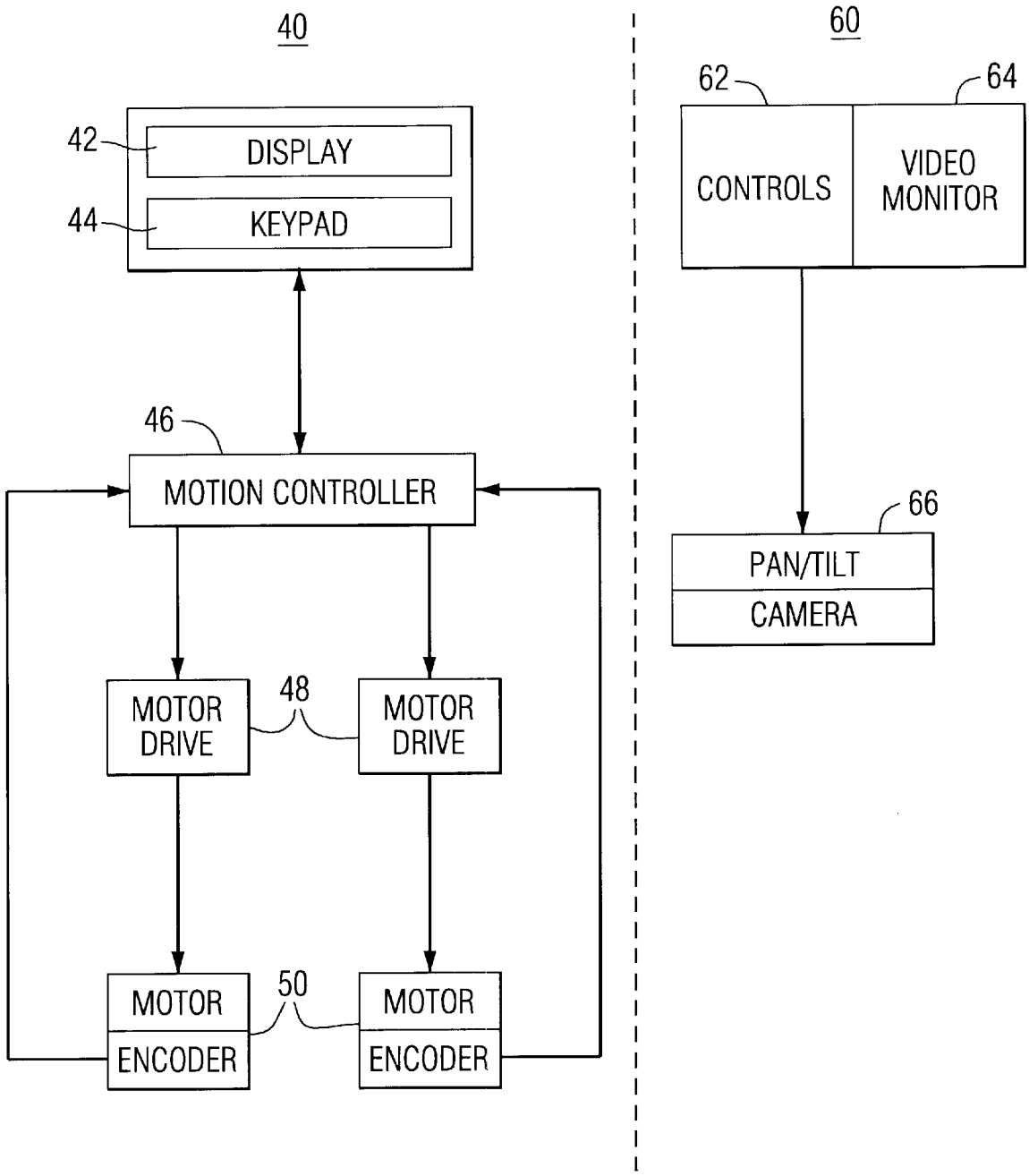
FIG. 3 shows a block diagram of the control system for this invention.

The control system for the mechanical delivery apparatus consists of a computer controlled, closed loop motion control, and a video inspection camera, not shown in the figures, for remote viewing of the thermal spray operation. FIG. 3 shows the block diagram of the control system. A 2-axis motion control system is shown as 40 with a display 42, keypad 44 connected in a motion controller 46 which controls motor drives 48 and motor encoders 50. A video control 60 contains control 62, video monitor 64 and pan/tilt camera 66. The circumferential and axial drives of the thermal spray system both use stepper motors, and the advantage of stepper motors is that they are brushless and will be able to handle the quick changing of direction that is required in the thermal spray operation. Each stepper motor has encoders on them that are fed to the motion controller and provide position and speed information.

The motion controller is the intelligence of the system and has a computer built into it. The motion controller has the ability to operate as an embedded system, where as soon as the system is turned on it will automatically run the computer program for that system. Along with controlling position and speed of each axis the motion controller has built-in safety features: it can detect motor stalls, it has over current and over speed trip points, and it can detect an operator emergency stop condition. The embedded computer program is stored on battery backed RAM so the program remains even when power is removed from the motion controller. The motion controller communicates with the operator through the use of the display and keypad. Through this interface the operator will set up the system parameters depending on whether the system is blasting, profiling or thermal spraying the pipe.

As mentioned previously, an additional feature of the control system is the use of a visual system for remotely observing the mechanical system during operation. The remote visual system is needed because the operator of the control system is outside of the pipe and during operation will not be able to directly observe the tool. If any part of the operation is malfunctioning it is important for the operator to quickly stop the operation of the tool. The visual system consists of a color CCD camera that has a remote focus, auto iris, and zooming capabilities and is mounted in a protective housing. The camera can also mount on a platform that can pan and tilt the camera. The controls for the camera and the pan/tilt units are mounted in the control system housing which also contains the video monitor. The hardware for the motion control and video systems are mounted in a portable enclosure that can be moved around to the proper viewing location.

It should be understood that the present invention may be embodied in other forms without departing from the spirit or essential attributes thereof, and accordingly, reference should be made to both the appended claims and to the foregoing specification as indicating the scope of the invention.

What is claimed is:

1. A machine for coating an interior surface of a hollow, axially elongated pipe comprising:

(a) a center portion of at least one support bar which can be aligned concentric with a centerline of the pipe;

(b) at least two tripods having at least three legs to contact the interior of the pipe and support the center portion of the support bar;

(c) at least one moveable carriage which can travel axially within the pipe, rotatably attached to the center portion of the support bar, said carriage containing at least one thermal spray coating device which extends from the carriage to the interior of the pipe;

(d) a source of thermal sprayable material;

(e) a motor to drive the carriage axially;

(f) a motor to rotate the center portion of support bar and the carriage;

(g) a programmable controller external to the pipe which is capable of controlling the motors and thermal spray coating device.

2. The machine of claim 1, wherein the center portion, the tripods and the movable carriage of the coating machine are themselves coated with an abrasion resistant plastic material.

3. The machine of claim 1, wherein the movable carriage also contains an abrasion cleaning profiling head.

4. The machine of claim 1, where the center portion, the tripods and the movable carriage are coated with polyurethane abrasion resistant material.

5. The machine of claim 1, where the legs of the tripod are telescoping legs covered with rubber.

6. The machine of claim 1, where both motors are brushless microstepping motors.

7. The machine of claim 1, where the carriage is moved along the support bar by a friction cable drive.

8. The machine of claim 1, where the carriage is moved along the support bar by a sprocket chain assembly.

9. The machine of claim 1, also containing a video inspection camera.

10. The machine of claim 1, where the thermal spray device is an electric/wire arc coating device.

11. The machine of claim 1, operating inside a pipe to thermal spray a coating on the inside of a pipe.

12. The machine of claim 1, where the thermal spray coating device is adjustable in increments.

* * * * *